US005155013A

United States Patent [19]

Sakuma et al.

[11] Patent Number: 5,155,013

[45] Date of Patent: Oct. 13, 1992

[54] RAPID PROCESS FOR LIGHT-SENSITIVE SILVER HALIDE PHOTOGRAPHIC MATERIAL CAUSING LESS CURVATURE AND FEASIBLE

[75] Inventors: Haruhiko Sakuma; Satoru Nagasaki, both of Tokyo, Japan

[73] Assignee: Konica Corporation, Tokyo, Japan

[21] Appl. No.: 724,508

[22] Filed: Jun. 28, 1991

Related U.S. Application Data

[63] Continuation of Ser. No. 409,075, Sep. 19, 1989, abandoned.

[30] Foreign Application Priority Data

Sep. 22, 1988 [JP] Japan ..... 63-238226
Nov. 28, 1988 [JP] Japan ..... 63-300267

[51] Int. Cl.[5] ..... G03C 7/46

[52] U.S. Cl. ..... 430/374; 430/9; 430/523; 430/527; 430/529

[58] Field of Search ..... 430/357, 374, 9, 523, 430/527, 529, 534

[56] References Cited

U.S. PATENT DOCUMENTS

| | | | |
|---|---|---|---|
| 2,584,362 | 2/1952 | Mueller | 430/527 |
| 2,972,535 | 2/1961 | Laakso et al. | 430/527 |
| 3,082,087 | 3/1963 | Guestaux et al. | 430/527 |
| 3,237,008 | 2/1966 | Dostes et al. | 430/523 |
| 3,437,484 | 4/1969 | Nadeau | 430/527 |
| 3,523,022 | 8/1970 | Byerley et al. . | |
| 3,627,533 | 12/1971 | Jacoby et al. | 430/523 |
| 4,585,730 | 4/1986 | Cho | 430/523 |
| 4,675,278 | 6/1987 | Sugimoto et al. | 430/527 |
| 4,701,403 | 10/1987 | Miller | 430/527 |
| 4,711,838 | 12/1987 | Grzeskowiak et al. | 430/523 |
| 4,828,971 | 5/1989 | Przezdziecki | 430/523 |

FOREIGN PATENT DOCUMENTS

| | | |
|---|---|---|
| 0179555 | 4/1986 | European Pat. Off. . |
| 1035184 | 7/1966 | United Kingdom . |

OTHER PUBLICATIONS

Patent Abstracts of Japan, vol. 11, No. 324 (p. 628) [2771], Oct. 22, 1987 of JP-A-62 108 246 (Konishiroko Photo Ind. Co. Ltd) May 19, 1987.

Photographic Science and Engineering, vol. 1, No. 2, Oct. 1957, p. 69-73; J. Q. Umberger: "The Fundamental Nature of Curl and Shrinkage . . . "

*Primary Examiner*—Jack P. Brammer

*Attorney, Agent, or Firm*—Finnegan, Henderson, Farabow, Garrett and Dunner

[57] ABSTRACT

A photographic material causing less curvature and feasible for rapid processing is disclosed. The photographic material comprises a light-sensitive silver halide emulsion layer on one side on a support and a backing layer on the other side, wherein $T_E/T_B$, the ratio of the total dry layer thickness $T_E$ of the side having the silver halide emulsion layer to the total dry layer thickness $T_B$ of the side having the backing layer, is not less than 0.8 and not more than 1.5, and the amount of water absorbtion of the side of having the silver halide emulsion layer is not more than 8.5 g/m$^2$.

11 Claims, No Drawings

RAPID PROCESS FOR LIGHT-SENSITIVE SILVER HALIDE PHOTOGRAPHIC MATERIAL CAUSING LESS CURVATURE AND FEASIBLE

This application is a continuation of application Ser. No. 07/409,075 filed Sep. 19, 1989, now abandoned.

FIELD OF THE INVENTION

The present invention relates to a light-sensitive silver halide photographic material. More particularly, it relates to a light-sensitive silver halide photographic material having at least one silver halide emulsion layer on one side of a support and a backing layer on the other side thereof.

In the present specification, the "backing layer" refers to a non-light-sensitive silver halide colloid layer formed on the side opposite to the side on which a silver halide emulsion layer is provided.

BACKGROUND OF THE INVENTION

Light-sensitive materials having a silver halide emulsion layer on one side of a support and a backing layer on the other side thereof (hereinafter often "one-side light-sensitive material"), which have the composition not identical on each side, tend to cause curvature in the light-sensitive material. There are some disadvantages accompanying the curvature, and what is important, for example, is that it tends to cause carrying troubles when a light-sensitive material is carried with an automatic carrying device.

It also often occurs that the degree of curvature (hereinafter often referred to as "the degree of curl") varies depending on conditions. For example, changes in temperature or humidity cause the curvature in various ways because of the difference in the layer constitution on both sides of the one-side light-sensitive material, thus resulting in variation of the degree of curl. The variation of the degree of curl makes it more difficult to take a coutermeasure to the curvature.

On the other hand, light-sensitive silver halide photographic materials should preferably be feasible for rapid processing. Since, however, the one-side light-sensitive material is comprised of a light-sentive emulsion layer formed only on its one side, the amount of silver (or silver weight) on one side must be made larger in many instances when compared with the case when silver halide emulsion layers are formed on both sides. In such instances, it follows that the amount of hydrophilic colloids in the emulsion layer must also be made larger, resulting in a poorness in drying properties when processing is carried out. This brings about a disadvantage in carrying out the rapid processing.

For improving the drying properties, it is preferred to make smaller the amount of hydrophilic colloids in regard to the silver halide emulsion layer and also increase the degree of hardening to lower the water absorption properties of the emulsion layer. Taking only such measures, however, may cause a deterioration of photographic performance, for example, an increase in fog, a lowering of graininess, or a poorness in scratch resistance.

As previously mentioned, it is also desirable for the light-sensitive material to have a small variation in the degree of curl against changes in temperature and humidity. For this purpose, what is important is the balance of layer thickness between the backing layer and emulsion layer, and it may be commonly attempted to make large the thickness of the backing layer to take the balance. A large thickness of the backing layer, too, results in an increase in water-absorption to cause defective drying. This consequently goes against the demand for rapid processing.

As mentioned in the above, there are a demand for the prevention of curvature (and variation of the degree of curl) and a demand for rapid processing with regard to the one-side light-sensitive material. It, however, is difficult to satisfy the both.

As pointed out in the above, the one-side light-sensitive material has a large silver weight on one side of a support, and in some instances the one side is coated with a silver halide emulsion in such a large silver weight that corresponds to the total silver weight on both sides of a both-side light-sensitive material. Such a large weight of silver present on the one side may make it impossible to sufficiently carry out fixing when the processing is made under rapid processing, resulting in a large quantity of remaining silver salts. As a result, the storage stability may be worsened, often causing a deterioration of the image quality during the storage of images obtained by the processing.

This problem can be solved by making small the silver weight on the emulsion layer side. Making small the silver weight on the emulsion layer side, however, may often cause other problems.

As an important problem, there is the problem that the decrease in the silver weight makes it difficult to detect a light-sensitive material.

For example, in CRT photography in which an infrared sensor detects a light-sensitive material used for photography, the sensor can not achieve the detection it the silver weight is small, so that all the operations after the detection, for example, carriage of the light-sensitive material, can not be performed.

Of course, the silver weight may be increased to solve such a problem in the detection, but this may cause difficulties such as defective fixing, which go against the fundamental demand of achieving rapid processing.

SUMMARY OF THE INVENTION

An object of the present invention is to solve the above problems involved in the prior art and provide a one-side light-sensitive material causing a small curvature, having a small variation of the degree of curl even when the curvature has been caused, and yet have a good adaptability to rapid processing, having a superior photographic performance such as sensitivity even when the rapid processing is carried out.

Another object of the present invention is to provide a one-side light-sensitive silver halide photographic material suited for rapid processing, and achieving a good detecting performance and carrying performance even when the light-sensitive material is embodied, for example, as a light-sensitive material used for CRT photography in which a sensor detects the light-sensitive material.

To achieve the above objects, the light-sensitive silver halide photographic material of the present invention comprises a support having on one side thereof a light-sensitive silver halide emulsion layer and on the other side thereof a backing layer, wherein $T_E/T_B$, the ratio of the total dry layer thickness $T_E$ on the side having said silver halide emulsion layer to the total dry layer thickness $T_B$ of the side having said backing layer, is not less than 0.8 and not more than 1.5, the water absorption on the side having said silver halide emulsion layer is not more than 8.5 g/m$^2$, and the water absorption on the side having said silver halide emulsion layer is smaller than the water absorption on the side having said backing layer.

Layers such as an anti-halation layer and a protective layer may be optionally provided on each side of the side having the silver halide emulsion layer and the side having the backing layer.

The light sensitive material of the present invention is preferably used when the rapid processing is carried out. In a preferred embodiment, the rapid processing is carried out under conditions corresponding to the following equation.

$$l^{0.75} \times T = 50 \text{ to } 124,$$

$$0.7 < l\ 4.0$$

wherein l represents a processing length (unit: m) at the time the light-sensitive silver halide photographic material is processed, and T represents a time (unit: second) required for said light-sensitive material to pass on said l.

The light-sensitive material of the present invention may preferably have a backing layer containing non-light-sensitive silver halide grains.

DETAILED DESCRIPTION OF THE INVENTION

In the light-sensitive material of the present invention, $T_E/T_B$, the ratio of the total dry layer thickness $T_E$ on the side having said silver halide emulsion layer to the total dry layer thickness $T_B$ of the side having said backing layer, is not less than 0.8 and not more than 1.5.

The layer thickness mentioned in the present invention refers to the dry layer thickness of photographic component layers on each side. It refers not to the thickness at the part locally protruded because of a matting agent or the like, but to an average thickness.

More specifically, it is theoretically a value obtained by dividing the weight $X_1$ g/cm$^2$ to $X_n$ g/cm$^2$, which is the weight of each additive contained per 1 cm$^2$ of a photographic component layer, by the density $D_1$ g/cm$^3$ to $D_n$ g/cm$^3$, of the substance. Thus the film thickness held by the additive can be calculated. Hence, the total layer thickness can be determined by the following equation.

$$\text{Total layer thickness} = \sum_{i=1}^{n} X_n/D_n$$

When actually measured, it can be known by fault observation using a microscope or measurement using a micrometer.

In the light-sensitive material of the present invention, the both layer thicknesses $T_E$ and $T_B$ satisfy the above conditions.

The above $T_E/T_B$ may preferably be not less than 1.1 and not more than 1.3.

In the light-sensitive silver halide photographic material of the present invention, the water absorption on the side having the silver halide emulsion layer is not more than 8.5 g/m$^2$. In addition, the water absorption on the side having the backing layer is smaller than the water absorption on the side having the silver halide emulsion layer.

The water absorption on the side having the emulsion layer may preferably range from 5.8 to 8.2 g/m$^2$. The water absorption on the side having the backing layer may also preferably range from 4.0 to 7.5 g/m$^2$.

In the present invention, the water absorption as the whole light-sensitive material may preferably be not more than 15 g/m$^2$. It may more preferably be not more than 13.5 g/m$^2$.

In the present invention, the water absorption is indicated by a difference between the weight under water-absorbed conditions and dry weight. This is a value obtained under the following conditions.

Namely, the light-sensitive material is subjected to developing;

at a temperature ranging from 20° C. to 26° C. and a relative humidity ranging from 50 to 70%; using;

| | |
|---|---|
| an automatic processor: | |
| SRX-501 (trade name; available from Konica Corporation) Processing mode: | 45 seconds |
| a developing solution: | |
| XD-SR (trade name; available from Konica Corporation)) | 35° C. |
| a bleaching solution: | |
| XF-SR (trade name; available from Konica Corporation)) | 33° C. |
| and washing water: city water | 18° C. |

In order to measure the water carry-over (water absorption) into the drying section, however, the drying section is dismantled and the dryer is not operated, where a wet weight is measured immediately (in 10 seconds) after the light-sensitive material comes out of the squeeseeing section. This light-sensitive material is further dried for 5 hours under conditions of a temperature of from 23° C. and a relative humidity of 55% and then the dry weight is measured. The difference in this wet weight and dry weight corresponds to the water absorption. To describe specifically, it is obtained by the following procedures:

A quarter film of MG-SR film (available from Konica Corporation) is continuously processed in the number of 100 sheets at intervals of one sheet in 7 seconds in a lightroom (the minor side of the film is faced in the direction of the progress of processing). Samples to be measured are also similarly processed under the same size and the same concentration at the same intervals, and the wet weight is measured immediately after they come out of a squeesee rack. The same samples are dried in the same way as the above to determine the difference between the dry weight and wet weight, and the difference is expressed in terms of an water absorption per 1 m$^2$. This is the water absorption according to the present invention.

The water absorption each on the side having the emulsion layer (hereinafter "emulsion side" for convenience) and on the side having the backing layer (hereinafter "backing side" for convenience) can be determined by the following formula.

Namely, in respect of each sample, three kinds of samples from which only the emulsion side, only the backing side, or both sides has or have been dissolved and removed using a proteolytic enzyme solution were prepared, and the water absorption is measured on each.

Herein, assuming the water absorption of the sample having both the emulsion side and backing side as $H_W$;

the water absorption of the sample in which only the emulsion side remains, as $H_E$;

the water absorption of the sample in which only the backing side remains, as $H_B$;

the water absorption of the sample in which only the support remains, as $B_W$; and the weight of the support $B_O$;

the water absorption of the emulsion side is determined from:

$$H_W - H_B - \frac{1}{2}(B_W - B_O)$$

and the water absorption of the backing side, from:

$$H_W - H_E - \frac{1}{2}(B_W - B_O).$$

To control the water absorption of each surface within the range of the present invention, various technical means can be used. For example, the desired water absorption can be obtained by adjusting the degree of hardening of the layer on each side. For another example, the water absorption of the backing side can be made smaller than that of the emulsion side by making the degree of hardening of the backing side larger than the degree of hardening of the emulsion side.

The light-sensitive material of the present invention may preferably have a silver weight of not more than 3.5 g/m$^2$. This is because the adaptability to rapid processing can be further enhanced.

The silver halide emulsion layer used in the light-sensitive material of the present invention may preferably be spectrally sensitized. For example, orthochromatic sensitization, panchromatic sensitization, and infrared spectral sensitization can be carried out.

It is also a preferred example that the present invention is applied as a light-sensitive material used for a laser printer, using an infrared spectral sensitizing dye as disclosed in Japanese Patent O.P.I. Publication No. 192242/1984, represented by Formula (I) or (II) or an infrared spectral sensitizing dye as disclosed in Japanese Patent O.P.I. Publication No. 56652/1988, pages 325–326.

Silver halides used may be appropriately selected from those used in usual silver halide emulsions, such as silver bromide, silver iodobromide, silver chlorobromide and silver chloride, depending on the purpose for which the light-sensitive material is used. Silver iodobromide may preferably be used.

In the present invention, the non-light-sensitive silver halide grains contained in the backing layer may preferably be non-light-sensitive, but may be satisfactory if it is substantially non-light-sensitive. Herein, the "substantially non-light-sensitive" is meant to be light-sensitive to the extent no blackening may be caused as a result of developing even when the silver halides have been exposed to light.

There are no particular limitations on the halogen composition of such non-light-sensitive silver halide grains. For example, there can be used any of silver bromide, silver chlorobromide, silver iodobromide, and so forth. Silver bromide or silver iodobromide may preferably be used. When silver iodobromide is used, particularly preferred is the one containing not less than 1.5 mol % of iodine. These silver halide grains may preferably be not subjected to chemical ripening.

The non-light-sensitive silver halide grains used in the present invention may preferably have a grain size of not less than 0.3 μm when an additional effect of reflection or scattering of light is expected. The size may preferably be not more than 1.9 μm from the viewpoint of the influence on photographic performance. It may particularly preferably be within the range of from 0.5 to 1.7 μm. In the present invention, however, the grain size of the non-light-sensitive silver halide grains is not necessarily an important subject.

In the meantime, the grain size is meant to be a diameter of a grain when the grain is spherical, and, when it is not spherical, a diameter obtained by calculating its projection image as a circle having the corresponding area.

The non-light-sensitive silver halide may preferably be contained in the backing layer in an amount ranging from 3.0 to 20 mg/dm$^2$, and more preferably from 4.0 to 10 mg/dm$^2$.

In the present invention, the non-light-sensitive silver halide is contained in the backing layer. It may be contained in any layers in instances in which the backing layer is comprised of two or more layers. It may also be included separately in each layer.

The backing layer may optionally contain a water-soluble dye or the like.

A preferred embodiment according to which the light-sensitive material of the present invention is processed will be described below.

The processing length l determined when the light-sensitive material of the present invention is processed may preferably be in the range of more than 0.7 and less than 3.1 (unit: m). A length l not more than 0.7 makes each processing step excessively short, often resulting in a lowering of sensitivity, and also makes small the number of rollers used, often resulting in a poor carrying performance, when applied in an apparatus in which light-sensitive materials are carried using a roller system.

On the other hand, a length l not less than 3.1 may make the carrying speed excessively high, often tending to make scratches on films.

The product of $l^{0.75}$ and T may preferably be not less than 50 and not more than 124. A value less than 50 may often result in a lowering of the sensitivity of the light-sensitive material, or may bring color remaining into question. The product of $l^{0.75}$ and T may more preferably be not less than 76.

On the other hand, a value more than 124, of the product of $l^{0.75}$ and T may often cause a deterioration of the graininess of photographic images although the sentivity is little increased, and also bring about an increase in fog.

According to the processing conditions described above, it is possible to obtain the good results that the graininess is good irrespective of high sensitivity and yet defective fixing, defective washing or defective drying may occur with difficulty.

In instances in which the processing is carried out using an automatic processor, it is preferred to use an automatic processor of a roller carriage type. In such instances, the number of all carrying rollers may preferably be such that a value obtained by dividing the processing length l by the number of rollers is in the range of from 0.01 to 0.04. The time required for each processing section may preferably be in the following range.

| | |
|---|---|
| Insertion + developing + carrying: | 25 to 40% |
| Fixing + carrying | 12 to 25% |
| Washing + carrying | 10 to 25% |
| Squeegeeing + drying | 25 to 45% |
| Total | 100% |

Rollers used may preferably range between 12 mm and 60 mm in diameter at the carrying section, and between 30 cm and 110 cm in length. Rollers made of various materials can be used. For example, those of a Bakelite type (which may contain glass powder, metal powder or plastic powder) and those of a rubber type (such as Neoprene, isoprene or silicone rubber) can be used at the developing, fixing, washing and drying sections. At the carrying sections or sqeeseeing section, preferably used are silicone rubbers having water repellency and resiliency, or synthetic leathers as exemplified by "Kurarino" (trade name; available from Kuraray).

Processing solutions such as a developing solution and a fixing solution used in the processing may be selected from appropriate ones depending on the light-sensitive material.

EXAMPLES

The present invention will be described below by giving Examples.

EXAMPLE 1

An emulsion containing flat-plate silver iodobromide grains having an average grain diameter of 1.71 μm and an aspect ratio of about 16:1 was prepared according to the method used in preparing Emulsion 3 (Example) disclosed in Japanese Patent Publication Open to Public Inspection (hereinafter "Japanese Patent O.P.I. Publication") No. 113927/1983. The present grains comprises silver iodobromide grains holding 80% or more of the total projected areas. In the present grains, however, spectral sensitizing dyes A and B were added before desalting, in a weight ratio of 200:1 and in an amount of 1,000 mg in total per mol of silver halide.

In adding the spectral sensitizing dyes, the pH was adjusted to pH 7.60, phenylcarbamylated gelatin was added after 15 minutes, the pH was lowered using acetic acid, followed by agglomeration, and then the supernatant was removed.

To the grains thus obtained, deionized water was added so as to give a volume of 500 ml per 1 mole of the silver halide grains. The resulting mixture was heated to 52° C., and then the spectral sensitizing dyes A and B were added therein in a weight ratio of 200:1 and in an amount of 100 mg in total per mol of silver halide. After 10 minutes, 0.6 g of a styrene/maleic anhydride copolymer was added therein. After 2 minutes, ammonium thiocyanate in an amount of $2.6\times10^{-3}$ mol per mol of silver, and chloroauric acid and sodium thiosulfate in appropriate amounts were further added. Chemical ripening was thus initiated. This chemical ripening was carried out under conditions of pH 6.02 and silver potential of 49 mV.

Fifteen (15) minutes before completion of the chemical ripening (80 minutes after initiation of the chemical ripening), potassium iodide was added in an amount of 300 mg per mol of silver, 10% (w/v) acetic acid was added after 5 minutes, the pH value was lowered to 5.6, and the resulting pH was maintained for 5 minutes. Thereafter, a 0.5% (w/v) potassium hydroxide solution was added, the pH was adjusted to 6.15, and thereafter 4-hydroxy-6-methyl-1,3,3a,7-tetrazaindene and lime-treated osein gelatin were added in an amount of $4\times10^{-2}$ mol and so as to give the coating weight as described later, respectively. The chemical ripening was thus completed to prepare a photographic emulsion coating solution.

After the preparation of the photographic emulsion coating solution, the pH was 6.30, and the silver potential, 85 mV (35° C.).

The photographic emulsion coating solution thus prepared was applied on the surface of one side of a support to provide a photographic emulsion layer. As the support, here was used a polyethylene terephthalate film of 175 μm thick.

The photographic emulsion layer was provided by coating so as to give a coating weight of 3.2 g/m$^2$ in terms of silver, per one side of the support, and a gelatin weight of 2.2 g/m$^2$. Using the protective layer solution as described later, a protective layer was also formed on the emulsion layer. This protective layer was provided by coating so as to give a coating weight of 1.1 g/m$^2$ of gelatin. A backing layer is provided on the surface opposite to the side having the emulsion layer. This, however, is formed to be comprised of a lower backing layer and an upper backing layer. More specifically, the backing layer as described below was provided in the manner that the lower backing layer and upper backing layer were provided by simultaneous coating on both sides of a polyethylene terephthalate base so as to give gelatin coating weights of 3.0 g/m$^2$ and 1.2 g/m$^2$, respectively, using two sets of slide hopper coaters at a speed of 80 m/min, followed by drying in 2 minutes 20 seconds. Samples were thus obtained.

The sample thus obtained was inserted to a fluorescent intensifying screen KO-250 (available from Konica Corporation), which was then irradiated with X-rays at a tube voltage of 130 KVP at 20 mA for 0.05 second to effect exposure through a penetrometer Type B (aluminum steps; available from Konica Medical Corporation). Thereafter, processing was carried out in 45 seconds with Konica Automatic Processor SRX-501, using processing solutions (a developing solution and a fixing solution).

Samples 1 to 9 all had a layer thickness $T_E$ of 3.45 μm, on the side having the emulsion layer, and a layer thickness $T_B$ of 3.2 μm, on the side having the backing layer, the ratio of the both, $T_E/T_B$, being 1.078.

The following are the spectral sensitizing dyes used in preparing the samples.

Spectral sensitizing dye A:

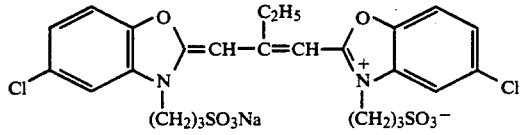

Spectral sensitizing dye B:

-continued

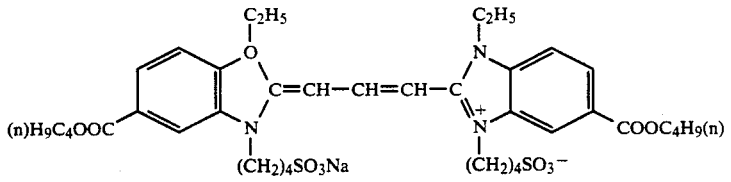

The following are the additives used in the silver halide photographic emulsion coating solution. The amount for addition is indicated as an amount per mol of silver halide.

| | |
|---|---|
| 1,1-Dimethylol-1-bromo-1-nitromethane | 70 mg |
| 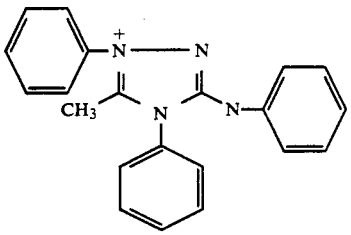 | 150 mg |
| t-Butyl-catechol | 400 mg |
| Polyvinyl pyrrolidone (molecular weight: 10,000) | 1.0 g |
| A styrene/maleic anhydride copolymer | 2.5 g |
| Trimethylolpropane | 10 g |
| Diethylene glycol | 5 g |
| Nitrophenyl-triphenylphosphonium chloride | 50 mg |
| Ammonium 1,3-hydroxybenzene-4-sulfonate | 4 g |
| Sodium 2-mercaptobenzimidazole-5-sulfonate | 1.5 g |
| 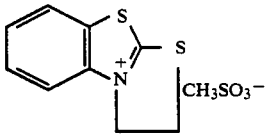 | 70 mg |
| $n\text{-}C_4H_9OCH_2CH(OH)CH_2N(CH_2COOH)_2$ | 1 g |

The protective layer solution had the following composition. The amount for addition is indicated as an amount per liter of the coating solution.

| | |
|---|---|
| Lime-treated inert gelatin | 68 g |
| Acid-treated gelatin | 2 g |
| $NaO_3S-CH(CH_2COO_{10}H_{21})-COOC_5H_{11}$ (a coating aid) | 1 g |

-continued

| | |
|---|---|
| Polymethyl methacrylate (a matting agent of 1.2 μm in area average particle diameter) | 1.1 g |
| Silicon dioxide particles (a matting agent of 1.2 μm in area average particle diameter) | 0.5 g |
| Ludox AM (colloidal silica available from DuPont Co.) | 30 g |
| 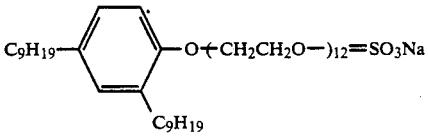 | 1.0 g |
| 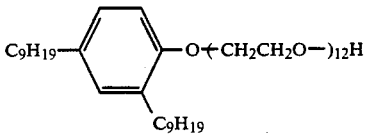 | 0.4 g |
| $CH_2COO(CH_2)_9CH_3$ / $CHCOO(CH_2)_2CH(CH_3)_2$ / $SO_3Na$ | 0.3 g |
| 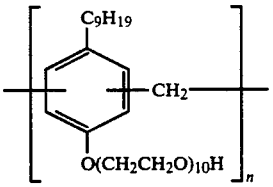 (a mixture of n = 2 to 5) | 2.5 g |
| $NaO_3S-CH(CH_2COOCH_2(C_2F_4)_3H)-COOCH_2(C_2F_4)_3H$ | 0.5 g |
| $F_{19}C_9-O(CH_2CH_2O)_{10}-CH_2CH_2-OH$ | 3 mg |
| $C_4F_9SO_3K$ | 2 mg |
| $C_{10}H_{21}CONH(CH_2CH_2O)_6H$ | 3 g |

In addition to the above additives, the following compounds (1) and (2) were added in the emulsion coating solution so as to give the following amount per mol of silver halide.

(1) 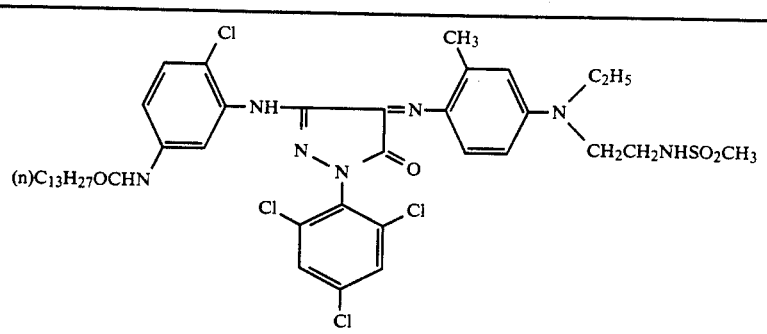 200 mg (2) Tricresylphosphate 0.6 g

More specifically, a dispersion obtained by dissolving the compound (1) in an oil comprising the compound (2) following the procedures described in (3) of Example 1 in Japanese Patent O.P.I. Publication No. 285445/1986, which were then dispersed in a hydrophilic colloidal solution, was added so as to give the above amount.

The coating solution for providing the backing layer was prepared in the following manner.

| Backing layer | |
|---|---|
| (Lower backing layer solution) | |
| Per 1 liter of the coating solution; | |
| Lime-treated gelatin | 70 g |
| Acid-treated gelatin | 5 g |
| Trimethylolpropane | 1.5 g |
| Backing dye A | 1.0 g |
| Backing dye B | 1.0 g |
| (Upper backing layer solution) | |
| Per 1 liter of the coating solution; | |
| Lime-treated gelatin | 70 g |
| Acid-treated gelatin | 5 g |
| Trimethylolpropane | 1.5 g |
| Backing dye A | 1.0 g |
| Backing dye B | 1.0 g |
| $KNO_3$ | 0.5 g |
| $C_{10}H_{21}CONH(CH_2CH_2O)_6H$ | 1.5 g |
| 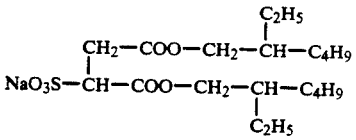 | 0.4 g |
| $F_{19}C_9O(CH_2CH_2O)_{10}CH_2CH_2OH$ | 0.1 g |
| $NaO_3S-CH(CH_2COOCH_2(C_2F_4)_3H)-COOCH_2(C_2F_4)_3H$ | 0.3 g |
| 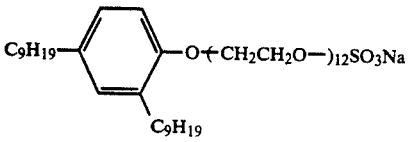 | 1.0 g |
| Polymethyl methacrylate particles of 3.5 μm in area | 1.1 g |

-continued

| Backing layer | |
|---|---|
| average particle diameter | |

Backing dye A

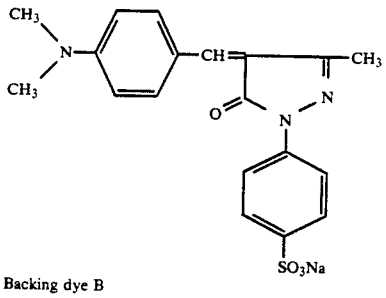

Backing dye B

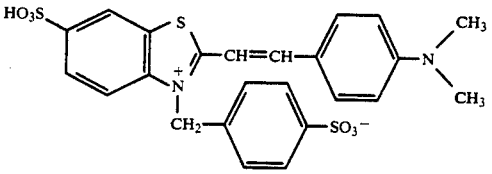

In the protective layer solution applied on the emulsion side and the upper backing layer solution applied on the backing side, the following hardening agent solution was added in such an amount that the water absorption of the layers on the respective sides may be adjusted to the water absorption as shown in Table 1. Samples 1 to 9 were thus prepared which each have a different water absorption as shown in Table 1.

The water adsorption on the side of each surface, shown in Table 1, was measured by the method as defined in the above "DETAILED DESCRIPTION OF THE INVENTION".

| (Hardening agent solution) | |
|---|---|
| An aqueous 2% solution of sodium 2,4-dichloro-6-hydroxy-1,3,5-triazine (a hardening agent) | 10 ml |
| Formalin, 35% (a hardening agent) | 0.6 ml |
| An aqueous 40% glyoxal solution (a hardening agent) | 1.5 ml |
| By the addition of water, made up to | 50 ml |

On each sample, sensitivity was measured and also drying properties were examined.

The sensitivity was indicated by calculating it as a relative sensitivity, assuming as 100 the reciprocal of the amount of X-ray that gives a blackening density of fog +1.0, of Sample No. 1 in Table 1. Drying properties were evaluated based on the criterions set out later.

The processing in the present Example was carried out under the following conditions. Namely, the light-sensitive materials serving as samples were processed under a processing length l=1.95 (m) and a processing time T=45 (seconds). ($l^{0.75} \times T = 74.26$).

In the present Example, the samples were processed using an automatic processor SRX-501 of Konica Corporation. The place at which the automatic processor was installed had a temperature of 25° C. and a relative humidity of 62%.

In evaluating the drying properties, however, the processing machine and processing agents were used under the same conditions as the measurement of sensitivity so that practical drying properties can be confirmed, but the place at which the automatic processor was installed was made to have an atmosphere of a temperature of 25° C. and a relative humidity of 80%. The drying properties of each sample were thus confirmed.

The manner of processing the samples, size, and exposure density were made identical with those in the case of the measurement of water absorption.

Drying properties were evaluated based on the following criterions, with five-rank evaluation.

| Criterions for evaluation of drying properties | |
|---|---|
| 1. Completely dried, samples being warm | A |
| 2. Completely dried, samples being cold | B |
| 3. Somewhat wet (not more than $\frac{1}{3}$) | C |
| 4. Wet (not more than $\frac{2}{3}$) | D |
| 5. Wet (more than $\frac{2}{3}$) | E |

Results of the above evaluation are shown in Table 1. The evaluation on drying properties was made under the same conditions as the measurement of water absorption described above because the degree of drying on the side of each sample had to be examined. Results of the present evaluation, however, correlate with instances in which the processing using an automatic processor is carried out under usual conditions.

The following developing solution and fixing solution were used.

| | |
|---|---|
| (Developing solution) | |
| XD-SR | 35° C. |
| (SRX-501; XD-SR-S in an amount of 20 ml/l was added to the developing tank) | |

-continued

| | |
|---|---|
| (Fixing solution) | |
| XF-SR | 33° C. |
| (63 cc/one quarter replenishment) | |
| (Washing water) | |
| City water | 18° C. |
| (3.0 l/min supply) | |

TABLE 1

| Sample No. | Water absorption on emulsion layer side | Amount of Amount of hardening agent solution added in emulsion side protective layer solution (ml/l) | Water absorption on backing layer side | Amount of hardening agent solution added in upper backing layer solution (ml/l) | Toral water absorption | Relative sensitivity | Drying properties | Remarks |
|---|---|---|---|---|---|---|---|---|
| 1 | 5.5 | 86 | 6.5 | 125 | 12.0 | 100 | A | X |
| 2 | 7.0 | 68 | 6.5 | 125 | 13.5 | 112 | A | Y |
| 3 | 8.4 | 50 | 6.5 | 125 | 15.0 | 116 | B | Y |
| 4 | 10.0 | 41 | 6.5 | 125 | 16.5 | 118 | D | X |
| 5 | 5.5 | 86 | 6.9 | 115 | 13.5 | 100 | A | X |
| 6 | 7.0 | 68 | 6.9 | 115 | 15.0 | 112 | A | Y |
| 7 | 8.6 | 48 | 8.0 | 93 | 16.5 | 116 | D | X |
| 8 | 10.0 | 41 | 8.0 | 93 | 18.5 | 118 | E | X |
| 9 | 8.6 | 48 | 6.5 | 125 | 15.1 | 116 | D | X |

X: Comparative sample
Y: Sample of the invention

As will be seen from Table 1, the samples according to the present invention can achieve a high sensitivity, with good drying properties. For example, comparison of Sample 3 (the present invention) with Sample 9 (comparative example) tells that superior results can be obtained when the water absorption is within the range of the present invention.

The degree of curl was also confirmed on each sample by continuously varying the relative humidity from 20% to 80% at 23° C. The samples according to the present invention showed less curl and less change with good results.

All the samples 1 to 9 had a melting point to water, of not less than 94° C.

As a tendency of the graininess, there was a tendency to an improvement of the graininess with a decrease in the water absorption, in respect of the samples Nos. 4, 7, 8 and 9 having a water absorption of more than 8.5 on the emulsion side. On the other hand, in respect of the samples Nos. 3, 2, 6, 1 and 5 having a water absorption of not more than 8.5, there was a tendency that the graininess became substantially uniform in a good state.

EXAMPLE 2

Using the same emulsion solution, protective layer solution and backing layer solution as those in Example 1, Example 1 was repeated to prepare Samples 10 to 22 having different water absorption, except that the dry coating layer thickness of the emulsion side and that of the backing side were adjusted by changing the amount of the emulsion coating solution and lower backing layer solution and the amount of the hardening agent, and also the degree of hardening was changed by adjusting the amount of the hardening agent solution used in Example 1. Similar evaluation was made. Results obtained are shown in Table 2. Evaluation on the variation of the degree of curl was made in the following manner.

Measurement of the Degree of Curl

The relative humidity was changed from 20% to 80% at a temperature of 23° C., and changes in the degree of curl during that time were observed.

A: Little change observed.

B: A little change observed.

C: A great change observed.

As shown in Table 2, the samples according to the present invention have a high sensitivity, good drying properties and less variation in the degree of curl, with good results.

TABLE 2

| Sample No. | Dry Dry layer thickness on emulsion side | Dry layer thickness on backing layer side | Dry layer thickness ratio | Water Water absorption on emulsion side | Water Water absorption on backing layer side | Total water absorption | Relative sensitivity | Drying properties | Degree of curl | Remarks |
|---|---|---|---|---|---|---|---|---|---|---|
| 10 | 2.9 | 1.8 | 1.61 | 6.0 | 3.4 | 9.4 | 110 | A | C | X |
| 11 | 2.9 | 2.2 | 1.32 | 6.0 | 3.9 | 9.9 | 110 | A | A | Y |
| 12 | 2.9 | 2.6 | 1.15 | 6.0 | 4.5 | 10.5 | 110 | A | A | Y |
| 13 | 2.9 | 3.2 | 0.906 | 6.0 | 5.5 | 11.5 | 110 | A | A | Y |
| 14 | 2.9 | 3.9 | 0.744 | 6.0 | 6.6 | 12.6 | 110 | A | D | X |
| 15 | 3.4 | 2.2 | 1.55 | 6.9 | 3.9 | 10.8 | 112 | A | C | X |
| 16 | 3.4 | 2.7 | 1.26 | 6.9 | 4.6 | 11.5 | 112 | A | A | Y |
| 17 | 3.4 | 3.2 | 1.06 | 6.9 | 5.5 | 12.4 | 112 | A | A | Y |
| 18 | 3.4 | 4.3 | 0.791 | 6.9 | 7.2 | 14.1 | 112 | A | D | X |
| 19 | 2.9 | 3.2 | 0.906 | 8.6 | 5.5 | 14.0 | 118 | C | A | X |
| 20 | 2.9 | 3.2 | 0.906 | 4.7 | 5.5 | 10.5 | 101 | A | A | X |
| 21 | 3.4 | 3.2 | 1.06 | 5.6 | 5.5 | 11.1 | 102 | A | A | X |
| 22 | 3.4 | 3.2 | 1.06 | 8.8 | 5.5 | 14.3 | 117 | C | A | X |

X: Comparative sample
Y: Sample of the invention

EXAMPLE 3

While making control to 60° C., pAg=8.0 and pH=2.0, a monodisperse cubic emulsion of silver iodobromide grains having an average grain size of 0.25 μm and containing 2.0 mol % of silver iodide was obtained according to a double jet method. A part of the grains of this emulsion was used as cores to effect growth as follows: In a solution containing core grains and gelatin, an ammoniacal silver nitrate solution and a solution containing potassium bromide and potassium iodide were added at 40° C., pAg=8.0 and pH=9.5 according to the double jet method, to form first shells containing 40 mol % of silver iodide.

The rate of addition was gradually accelerated with the growth of grains.

The resulting emulsion was an monodisperse octahedral emulsion having an average grain size of 0.27 μm. The grains of this emulsion were used as cores, and an ammoniacal silver nitrate solution and a potassium bromide solution were added at pAg=11.0 and pH=9.0 according to the double jet method, to form second shells. A monodisperse emulsion having an average grain size of 0.41 μm was thus obtained. The emulsion obtained had an average silver iodide content of 2.0 mol %.

In the above emulsion, the following sensitizing dyes (a) and (b) were added, and the mixture was stirred for 10 minutes. Thereafter, $3.4\times10^{-3}$ mol of thiocyanate, per mol of silver, and appropriate amounts of chloroauric acid and sodium thiosulfate were added to carry out chemical ripening, and $1.3\times10^{-3}$ mol of potassium iodide, per mol of silver, was subsequently added to effect ripening for 15 minutes. Additives were further used to give the composition as described later to prepare a light-sensitive silver halide emulsion coating solution.

Sensitizing dyes:

(a)

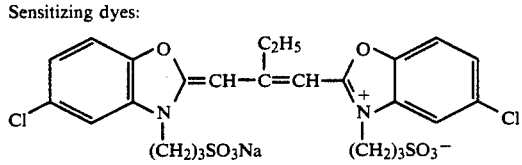

Amount: 320 mg per mol of silver halide (b)

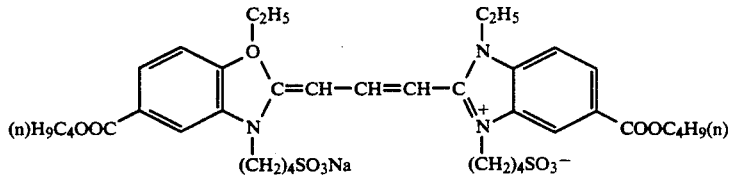

Amount: 35 mg per mol of silver halide

On the other hand, as a coating solution for the backing layer formed on the side opposite to the side coated with the light-sensitive silver halide emulsion coating solution, a coating solution was prepared with the composition described below.

Non-light-sensitive silver halide grains are also incorporated in the backing layer. For this purpose, the grains having the grain size as shown in Table 3 were incorporated in the backing layer coating solution used in each sample, so as to be in the amount as shown in Table 3. The coating solution was thus prepared.

The non-light-sensitive silver halide grains incorporated in the backing layer were prepared in the same manner as the light-sensitive silver halide grains described above, provided that they were so prepared as to give the average grain size as shown in Table 3 and an average silver iodide content of 2.0 mol %.

The composition of the backing layer coating solution, light-sensitive emulsion coating solution, and protective layer solution used for the formation of a protective layer which is the hydrophilic colloid layer formed on the light-sensitive emulsion layer side is shown below.

| (Composition of backing layer coating solution) Per liter of the coating solution; | |
|---|---|
| (a) Lime-treated inert gelatin | 60 g |
| (b) $C_7F_{15}CON(C_3H_7)(CH_2CH_2O)_2(CH_2)_3SO_3Na$ | 1 g |
| (c) 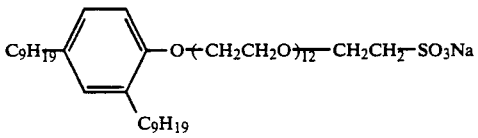 | 1.5 g |
| (d) $NaO_3S-CH(CH_2COO(CH_2)_9CH_3)COO(CH_2)_2CH(CH_3)_2$ | 1 g |
| (e) 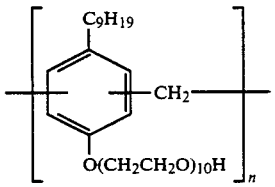 (a mixture of n = 3 to 6) | 3 g |
| (f) $C_8F_{17}SO_2N(C_3H_7)(CH_2CH_2-O-)_{15}-H$ | 1 g |
| (g) 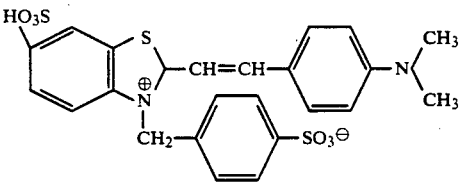 | 7 g |
| (h) 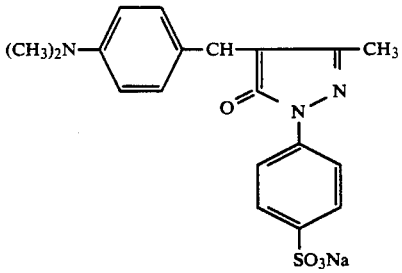 | 5 g |
| (i) 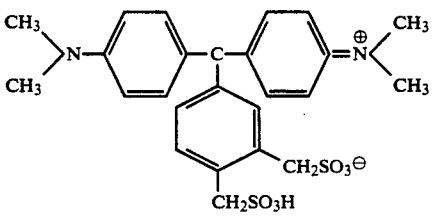 | 5 g |
| (j) N,N-ethylenebis-(vinylsulfonylacetamide)(10%) | 6 ml |
| (k) Sodium chloride | 1 g |

-continued

| (Composition of emulsion coating solution) Per 1 liter of the coating solution; | |
|---|---|
| (a) Lime-treated osein gelatin | 51 g |
| (b) 5-Methyl-1,3,4,7a-tetrazainden-7-ol | 0.8 g |
| (c) Silver halide grains | 0.6 mol |
| (d) 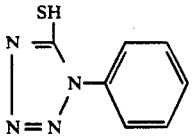 | 0.015 g |
| (e) Nitron | 0.05 g |
| (f) Fine particles of a styrene/butadiene copolymer (average particle diameter: 0.03 μm) | 2.5 g |
| (g) A styrene/maleic acid copolymer | 1.5 g |
| (h) 2,2-dihydroxymethyl-1-butanol | 8 g |

| (Composition of protective layer solution) Per 1 liter of the coating solution; | |
|---|---|
| (a) Lime-treated inert gelatin | 68 g |
| (b) Acid-treated gelatin | 1 g |
| (c) $C_7F_{15}CON(C_3H_7)(CH_2CH_2O)_2(CH_2)_3SO_3Na$ | 1 g |
| (d) 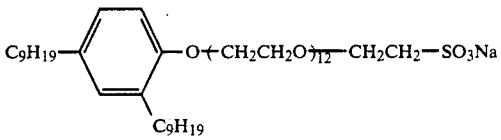 | 1.5 g |
| (e) $NaO_3S-CH(CH_2COO(CH_2)_9CH_3)COO(CH_2)_2CH(CH_3)_2$ | 1 g |
| (f) $C_9F_{19}O(CH_2CH_2O)_{10}CH_2CH_2OH$ | 1.5 g |
| (g) 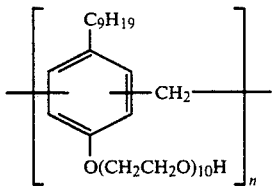 (a mixture of n = 3 to 6) | 3 g |
| (h) $C_4F_9SO_3K$ | 1 g |
| (i) A aqueous solution (2%) of sodium 2,4-dichloro-6-hydroxy-1,3,5-triazine | 5 ml |
| (j) An aqueous formaldehyde solution (35%) | 0.8 ml |
| (k) An aqueous glyoxal solution (40%) | 0.9 ml |
| (l) Sodium chloride | 1 g |

Using the above coating solutions, the emulsion layer was provided so as to give a hydrophilic colloid weight of 2.2 g/m$^2$, the protective layer, so as to give a gelatin coating weight of 1.1 g/m$^2$, and the backing layer, so as to give a hydrophilic colloid weight of 4.3 g/m$^2$, by simultaneous coating on both sides of a polyethylene terephthalate support, using two sets of slide hopper coaters at a speed of 65 m per minute. This support comprises a polyethylene terephthalate film of 175 μm thick, coated as a subbing solution with a copolymer aqueous dispersion obtained by effecting dilution so as to give a concentration of 10 wt. % of a copolymer comprised of three kinds of monomers of 50 wt. % of glycidyl methacrylate, 10 wt. % of methyl methacrylate and 40 wt. % of butyl methacrylate.

The silver weight on the emulsion layer side (the coating weight of light-sensitive silver halide grains) was adjusted to 33 mg/dm$^2$.

On the resulting samples, carrying-in-camera tests were made. More specifically, using KIC-G (manufactured by Konica Corporation), the carrying of 10 sheets of each sample was continuously carried out to examine the number of sheets which were surely carried. A CRT camera used here has an infrared light-emitting device and light-receiving device provided in pair, and has such a mechanism that a film carried on sufficiently intercepts infrared rays when it passes between the devices so that "film present" can be detected.

Results obtained are shown in Table 3.

TABLE 3

| Sample No. | Coating weight of light-sensitive silver halide emulsion (mg/dm²) | Non-light-sensitive silver halide grains contained in backing layer: Grain size (μm) | Coating weight (mg/dm²) | Carrying-in-camera performance a/10* | $T_E/T_B$ |
|---|---|---|---|---|---|
| 1 | 33 | — | — | 0/10 | 0.93 |
| 2 | 33 | 2.1 | 6 | 3/10 | 0.91 |
| 3 | 33 | 1.7 | 6 | 10/10 | 0.91 |
| 4 | 33 | 1.0 | 6 | 10/10 | 0.91 |
| 5 | 33 | 0.6 | 4 | 10/10 | 0.91 |
| 6 | 33 | 0.6 | 6 | 10/10 | 0.91 |
| 7 | 33 | 0.6 | 8 | 10/10 | 0.90 |
| 8 | 33 | 0.6 | 10 | 10/10 | 0.89 |
| 9 | 33 | 0.4 | 6 | 10/10 | 0.91 |
| 10 | 33 | 0.2 | 6 | 1/10 | 0.91 |
| 11 | 33 | 0.1 | 6 | 0/10 | 0.91 |

*a/10 represents the number of sheets of film which were able to be detected and carried without any problem when the 10 sheet continuous carrying tests were made.

Table 3 shows that films, used in a CRT camera, are detected and can be carried when the non-light-sensitive silver halide grains are incorporated in the backing layer of the light-sensitive material of the present invention, with appropriately selected grain size and content.

Tests were also made on a sample obtained by not adding to the backing layer the non-light-sensitive silver halide grains added to the backing layer of the sample No. 6 in Table 3, but mixing them with the light-sensitive silver halide used in the emulsion layer followed by coating, and a sample obtained by using the light-sensitive silver halide grains in an amount increased to the same amount as the non-light-sensitive silver halide grains followed by coating. As a result, the films were detected without any problem, but it was found that silver remained in a large weight under the rapid processing as in the present Example, bringing about a problem in maintaining image quality.

What is claimed is:

1. A method of processing a photographic element, said method comprising:

a) providing a photographic element;

b) processing said element for a time T in seconds in an apparatus having a processing length l in meters in accordance with the equation $$50 \leqq l^{0.75} \times T \leqq 124$$

wherein $0.7 < l < 4.0$, wherein said element comprises a support having on one side of said support a light-sensitive silver halide emulsion layer and on the other side of said support a backing layer consisting essentially of a hydrophilic colloid, wherein said backing layer is adapted for use in said photographic element, wherein $T_E/T_B$, the ratio of the total dry layer thickness $T_E$ of the side having the silver halide emulsion layer to the total dry layer thickness $T_B$ of the side having the backing layer, is not less than 0.8 and not more than 1.5, and wherein the amount of water absorption of the side having the silver halide emulsion layer is not more than 8.5 g/m².

2. The method of claim 1, wherein the water absorption of the side having the silver halide emulsion layer is smaller than that of the side having the backing layer.

3. The method of claim 1, wherein the backing layer contains non light-sensitive silver halide grains.

4. The method of claim 1, wherein the amount of water absorption of the side having the silver halide emulsion layer is 5.8 to 8.2 g/m².

5. The method of claim 1, wherein the amount of water absorption of the side having the backing layer is 4.0 to 7.5 g/m².

6. The method of claim 1, wherein the amount of water absorption of the photographic element as a whole is not more than 15 g/m².

7. The method of claim 1, wherein the amount of light-sensitive silver halide is not more than 3.5 g/m².

8. The method of claim 3, wherein the amount of the non light-sensitive silver halide grains in the backing layer is 3.0 to 20 mg/dm².

9. The method of claim 3, wherein the grain size of the non light-sensitive silver halide grains in the backing layer is 0.30 to 1.90 μm.

10. The method of claim 1, wherein said element is processed in accordance with the equation $$50 \leqq l^{0.75} \times T \leqq 76.$$

11. The method of claim 1, wherein said apparatus is an automatic processor and wherein said step of processing said element comprises inserting said element into said processor, developing said element, fixing said element, washing said element, squeegeeing said element and drying said element.

* * * * *